US009492828B2

(12) United States Patent
Nichols et al.

(10) Patent No.: US 9,492,828 B2
(45) Date of Patent: Nov. 15, 2016

(54) AUTOMATED CENTRIFUGE WITH SIDE AND TOP ACCESS

(75) Inventors: Michael J. Nichols, Brookline, MA (US); Louis J. Guarracina, Newburyport, MA (US)

(73) Assignee: HighRes Biosolutions, Inc., Woburn, MA (US)

( * ) Notice: Subject to any disclaimer, the term of this patent is extended or adjusted under 35 U.S.C. 154(b) by 181 days.

(21) Appl. No.: 14/130,043

(22) PCT Filed: Jun. 29, 2012

(86) PCT No.: PCT/US2012/044859

§ 371 (c)(1),
(2), (4) Date: Dec. 30, 2013

(87) PCT Pub. No.: WO2013/003692

PCT Pub. Date: Jan. 3, 2013

(65) Prior Publication Data

US 2014/0135197 A1 May 15, 2014

Related U.S. Application Data

(60) Provisional application No. 61/503,435, filed on Jun. 30, 2011.

(51) Int. Cl.

| | |
|---|---|
| ***B04B 5/04*** | (2006.01) |
| ***B04B 15/02*** | (2006.01) |
| ***B04B 7/02*** | (2006.01) |

(52) U.S. Cl.

CPC ..... *B04B 7/02* (2013.01); *B04B 5/0414* (2013.01); *B04B 15/02* (2013.01)

(58) Field of Classification Search

CPC .... B04B 15/02; B04B 7/02; B04B 2007/025

USPC ..... 494/14, 60

See application file for complete search history.

(56) References Cited

U.S. PATENT DOCUMENTS

2004/0087426 A1* 5/2004 Lattanzi ..... B04B 5/0421 494/20
2011/0051133 A1* 3/2011 Ogawa ..... B04B 5/0407 356/246

FOREIGN PATENT DOCUMENTS

| | | | | |
|---|---|---|---|---|
| CN | S641746 A | 1/1989 | | |
| CN | 201676758 U | 12/2010 | | |
| DE | 3425706 A1 * | 1/1986 | ..... | B02C 15/08 |
| EP | 2010329 B1 | 1/2010 | | |
| WO | WO 2007124777 A1 * | 11/2007 | ..... | B02C 17/08 |

OTHER PUBLICATIONS

Patent Cooperation Treaty, International Search Report and Written Opinion of the International Searching Authority for PCT/US2012/044859 dated Nov. 28, 2012, 12 pages.

* cited by examiner

*Primary Examiner* — Charles Cooley
*Assistant Examiner* — Shuyi S Liu
(74) *Attorney, Agent, or Firm* — Hoffman Warnick LLC

(57) ABSTRACT

A housing for an automated centrifuge with side and top access is dis¬ closed. The housing includes an inner housing (104) for enclosing at least one labware nest (108) of the automated centrifuge, the inner housing having a top and a substantially cylindrical body, wherein the inner housing includes an opening through both a portion of the top and a portion of the body; and a door (114) configured to move be ¬ tween an open position in which the door exposes the opening and a closed position in which the door blocks the opening.

18 Claims, 7 Drawing Sheets

AUTOMATED CENTRIFUGE WITH SIDE AND TOP ACCESS

This application claims the benefit of U.S. Provisional Application Ser. No. 61/503,435 filed on Jun. 30, 2011, and entitled "AUTOMATED CENTRIFUGE WITH SIDE AND TOP ACCESS", which is incorporated by reference herein in its entirety.

TECHNICAL FIELD

Embodiments of the invention relate to an automated centrifuge housing with a door designed such that when opened, the door exposes a portion of both the front, i.e., side, and top of an interior of the automated centrifuge.

BACKGROUND

In a traditional manually-loaded centrifuge, a user would manually load labware, such as plates, tubes, racks of tubes, vials, racks of vials, or flasks, into the centrifuge through a door on the top of the centrifuge, or an opening on the top of the centrifuge. As automated centrifuges were developed, they typically also included a top opening, or top door. However, these top-loading centrifuge doors posed challenges when used with robotic loaders because typical robotic loaders are side-gripping, and side-gripping robots do not work with top-loading centrifuges. To solve that problem, side doors were developed for loading into an automated centrifuge. This side-loading door is compatible with side-loading robotic grippers, but visibility into the centrifuge was poor. Accordingly, current centrifuges are not compatible with the two kinds of robots, e.g., side-gripping and top-gripping, since side-loading centrifuges cannot work with top-gripping robots, and top-loading centrifuges cannot work with side-gripping robots.

SUMMARY

Given the limitations of side-loading-only doors and top-loading-only doors for centrifuges, e.g., difficulty interfacing with robotic loaders and difficulty in precisely teaching the robots to access the labware nests inside the centrifuge, embodiments of the invention disclosed herein provide solutions to these limitations. Specifically, a housing for an automated centrifuge is disclosed with a door designed such that when opened, the door exposes a portion of both the front, i.e., side, and top of an interior of the automated centrifuge.

A first aspect of the invention includes a housing for an automated centrifuge, the housing comprising: an inner housing for enclosing at least one labware nest of the automated centrifuge, the inner housing having a top and a substantially cylindrical body, wherein the inner housing includes an opening through both a portion of the top and a portion of the body; and a door configured to move between an open position in which the door exposes the opening and a closed position in which the door blocks the opening.

A second aspect of the invention includes an automated centrifuge comprising: at least one labware nest; a rotor for rotating the at least one labware nest around a fixed axis; an inner housing enclosing the at least one labware nest, the inner housing having a top and a substantially cylindrical body, wherein the inner housing includes an opening through both a portion of the top and a portion of the body; and a door configured to move between an open position in which the door exposes the opening and a closed position in which the door blocks the opening.

Embodiments of this novel design for an automated centrifuge housing are described in more detail below.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
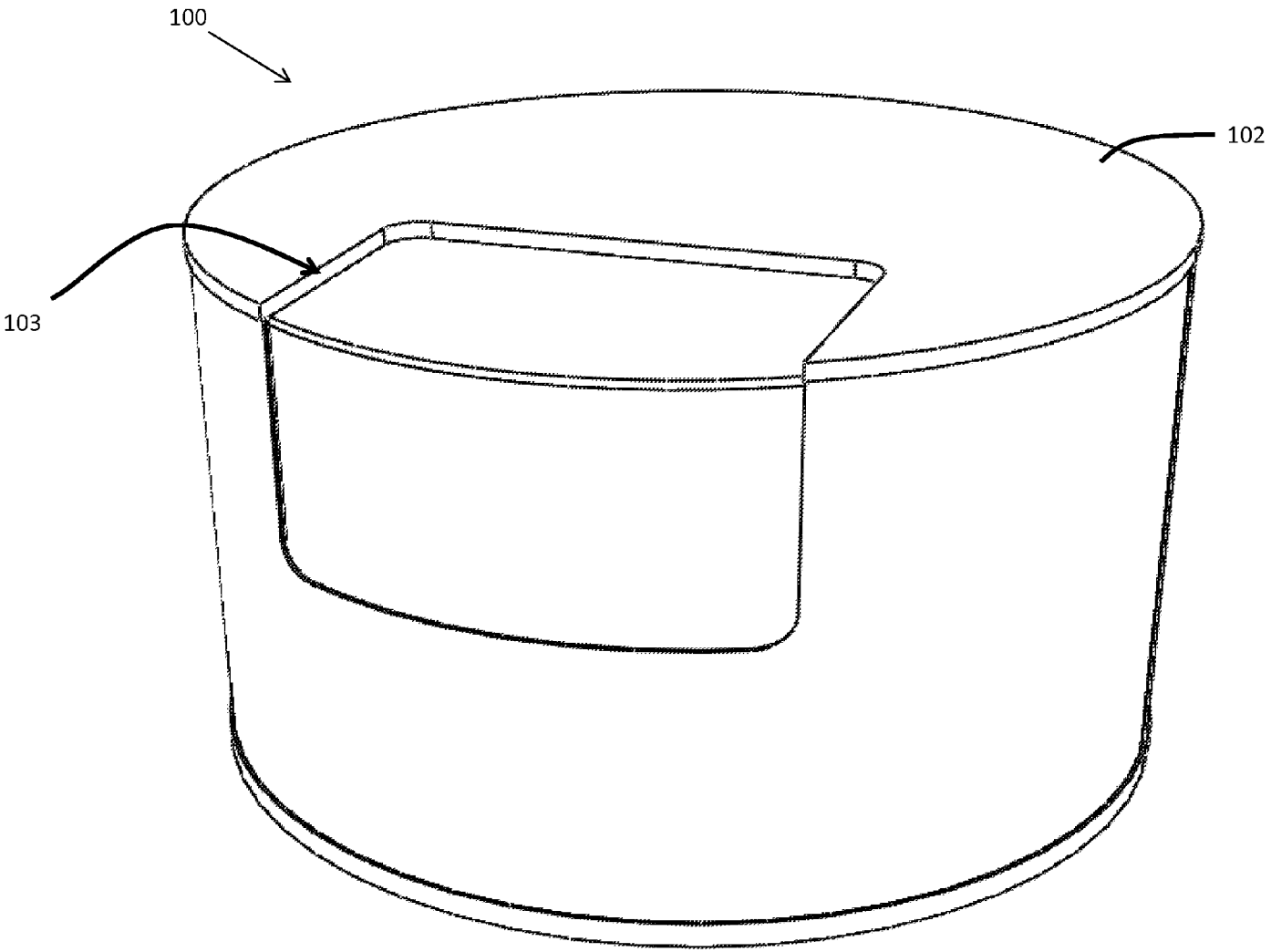
FIG. 1 shows a perspective view of an automated centrifuge according to an embodiment of the invention.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Figure 2:
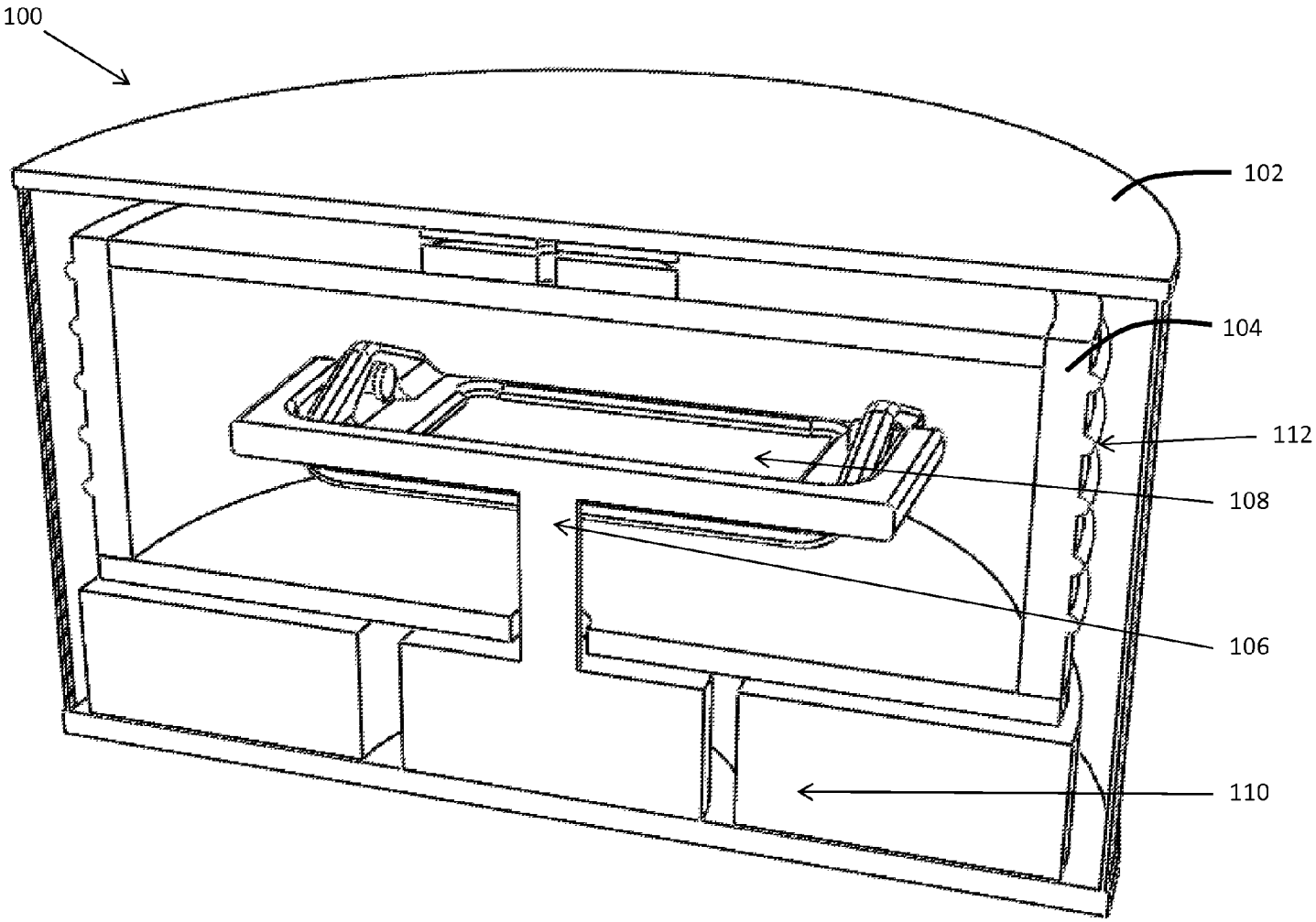
FIG. 2 shows a cut-away perspective view of an automated centrifuge according to an embodiment of the invention.

Turning to FIG. 1, a housing for use with an automated centrifuge 100 according to an embodiment of the invention is shown. A cut-away perspective view of automated centrifuge housing 100 is shown in FIG. 2. As shown in FIGS. 1 and 2, automated centrifuge housing 100 includes an outer housing 102, an inner housing 104, a rotor 106 and at least one labware nest 108. Nest 108 can be configured to hold any labware, for example, a microplate. However, while embodiments of this invention are discussed and shown herein in connection with microplates, it is understood that embodiments of this invention can be used for any known labware such as plates, tubes, racks of tubes, vials, racks of vials, flasks, etc. Automated centrifuge 100 further includes a control system 110 configured to control, among other things, rotor 106 and/or doors to access an interior of the automated centrifuge as discussed herein.

As understood by one of ordinary skill in the art, rotor 106 rotates labware nests 108 at high speeds around a fixed axis, applying force perpendicular to the fixed axis. Automated centrifuge 100 must be configured to withstand extreme speeds of rotor 106, and in the event that a nest 108 becomes dislodged, centrifuge 100 must be configured to withstand high impacts within inner housing 104. It is understood that any centrifuge or labware equipment can be used in connection with embodiments of the invention disclosed herein.

Figure 3:
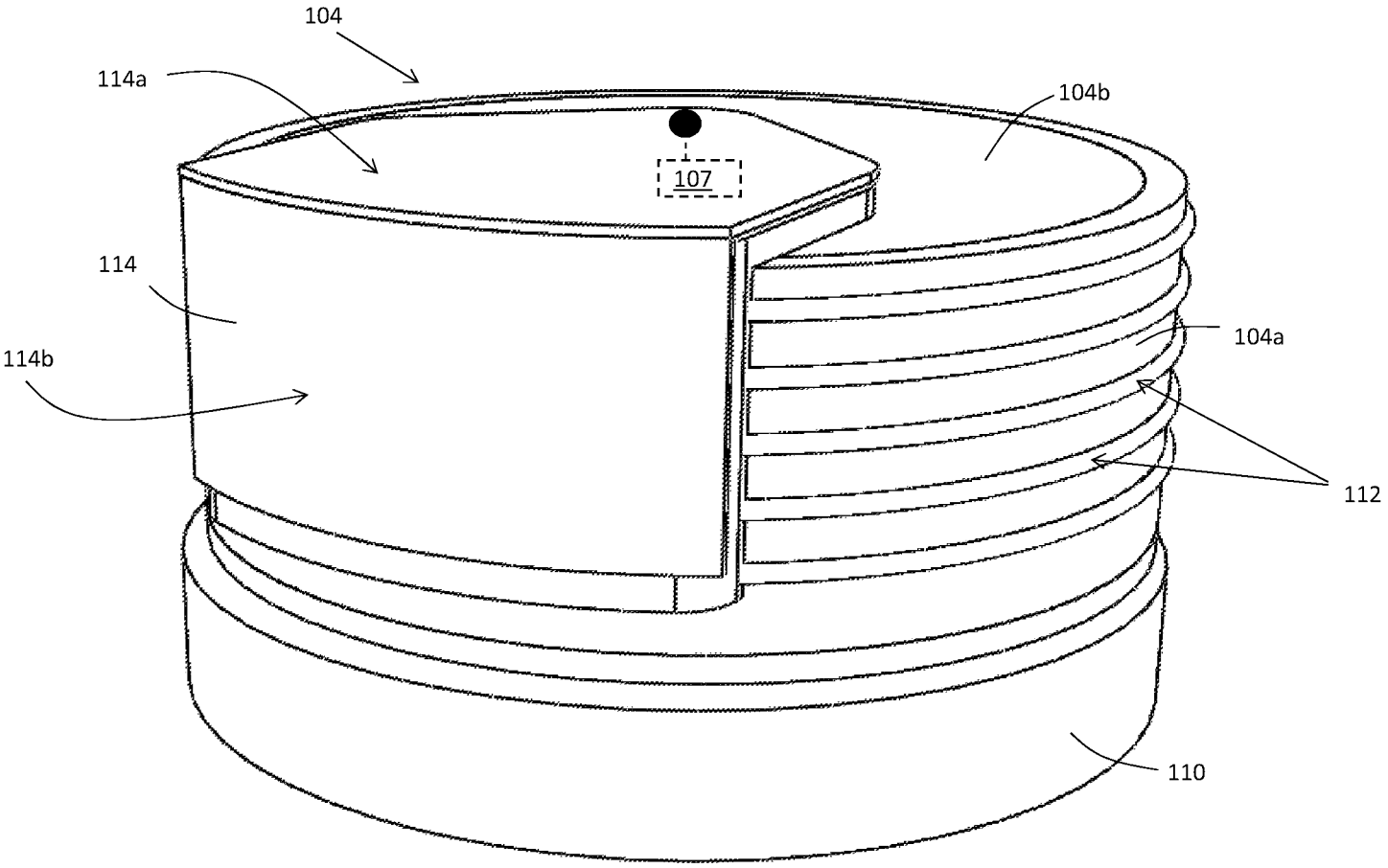
FIG. 3 shows a perspective view of the inner housing of an automated centrifuge according to an embodiment of the invention, with the door in a closed position.
Figure 4:
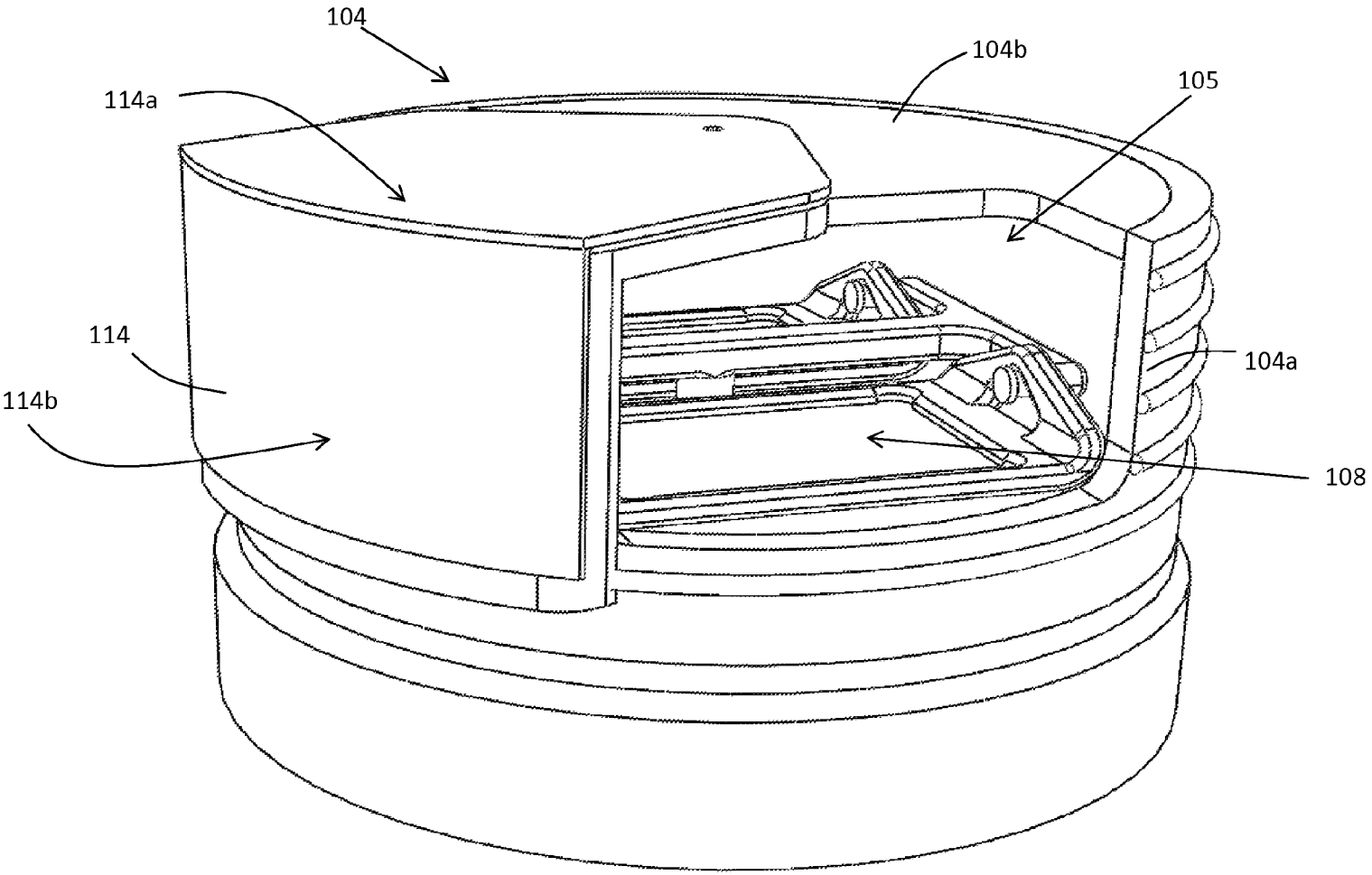
FIG. 4 shows a perspective view of the inner housing of an automated centrifuge according to an embodiment of the invention, with the door in an open position.

As shown in FIGS. 3 and 4, inner housing 104 comprises an explosion-proof housing that encloses nests 108 (FIG. 2) and rotor 106 (FIG. 2). In one embodiment, inner housing 104 can comprise a substantially cylindrical shape. For example, inner housing 104 can comprise a cylindrical body 104*a*, a top 104*b* and a bottom parallel to top 104*b* (bottom not visible in views of FIGS. 3 and 4). As best shown in FIG. 4, and discussed in more detail herein, inner housing 104 includes an opening 105 through both a portion of top 104*b* and a portion of cylindrical body 104*a*. Specifically, a portion of top 104*b* and a portion of cylindrical body 104*a* are cut-out to create opening 105. As shown in FIG. 1, outer housing 102 can also have an outer opening 103 substantially corresponding to the size and shape of opening 105. While substantially rectangular shaped openings 103, 105 are shown, it is understood that any size and shape opening can be utilized in embodiments of the invention. As discussed herein, openings 103, 105 can be configured to accommodate robotic apparatuses that need to access an interior of automated centrifuge 100. Therefore, larger openings can be used if necessary, as well as differently shaped openings, depending on the needs of a user.

As shown in FIG. 3, automated centrifuge 100 can further include coolant tubing 112 adjacent to inner housing 104. For example, coolant tubing 112 can be wrapped around cylindrical body portion 104*a* of inner housing 104. An external water bath or an internal compressor can be used to circulate refrigerant through coolant tubing 112.

As shown in FIGS. 3 and 4, automated centrifuge 100 further includes a door 114. As shown in FIGS. 3 and 4, door 114 is movable, e.g., rotatable, between an open position (FIG. 4) and a closed position (FIG. 3). As shown, door 114 can have a first portion 114*a* and a second portion 114*b*. First portion 114*a* can be substantially parallel to top 104*b* of inner housing 104, and can be pivotably attached to inner housing 104, for example, through the use of a pin or screw through a substantial center of top 104*b* of inner housing 104. Other known means of attaching first portion 114*a* to top 104*b* can be used, for example, using a tongue/groove where a groove could be included in either top 104*b* or first portion 114*a* and can be curved to correspond to the curved path traveled by door 114 as it slides around inner housing 104. As shown in FIG. 3, a trapezoidal shaped first portion 114*a* can be used, to fully cover the substantially rectangular shaped opening 105, as well as have a portion that extends towards a center of top 104*b* for attaching. However, any shape or size top portion 114*a* can be used, as long as opening 105 is fully blocked or covered by door 114 when in a closed position.

Second portion 114*b* can be substantially perpendicular to first portion 114*a* and can be shaped such that it has a curvature substantially corresponding to the curvature of cylindrical body 104*a* of inner housing 104. As such, second portion 114*b* can rotate, or slide, around an outer circumference of inner housing 104. Second portion 114*b* can also be pivotably attached to inner housing 104 in any way as desired, or can be adjacent to, and/or abut against, but not securely attached to, body 104*a*. In one embodiment, second portion 114*b* can use a tongue/groove, with a groove either along the outer circumference of body 104*a* or second portion 114*b* and a corresponding protrusion or tongue to matingly engage the groove to allow second portion 114*b* to travel along the outer circumference of body 104*a*. In another embodiment, second portion 114*b* is shaped such that it abuts the outer circumference of body 104*a* as it slides open and closed, but second portion 114*b* is not attached to body 104*a*.

Door 114 can be configured to open and close by sliding door 114 along the outer circumference of body 104*a*, (in one example, along a set of curved rails) or door 114 could be configured to be opened and closed (i.e., raised and lowered) through the use of a hinged joint. Regardless of how door 114 is moved, in an open position, door 114 exposes opening 105, and in a closed position, door 114 blocks opening 105. It is understood that while one example of a shape and configuration of door 114 is shown in FIGS. 3 and 4, any other desired shape and configuration of door 114 is possible. In one embodiment, a means for moving 107 (FIG. 3) is used to move door 114 between open and closed positions. In one embodiment, means for moving 107 can comprise a motor electrically coupled to control system 110 for automated centrifuge 100, or a control system separate from automated centrifuge 100. It is understood that means for moving 107 can comprise any known means for moving door 114 with respect to housing 104, for example, an electric motor, mechanical means, pneumatic means, electromagnetic means, linear motors, hydraulic means, etc.

FIGS. 3 and 4 illustrate door 114 moving between a first, closed, position (FIG. 3) and a second, open, position (FIG. 4). As illustrated in FIG. 3, in the closed position, the interior of inner housing 104 (including nest 108) is not accessible because opening 105 (FIG. 4) is covered or blocked. As illustrated in FIG. 4, in the open position, the interior of inner housing 104 (including nest 108) is accessible because opening 105 is exposed. Specifically, as shown in FIG. 4, in the open position, a portion of top 104*b* is exposed, along with a portion of cylindrical body 104*a*. In other words, the interior of inner housing 104 is accessible through the top and the side/front, i.e., through opening 105 which spans both the top 104*a* and the front 104*b* of automated centrifuge 100.

Figure 5A:
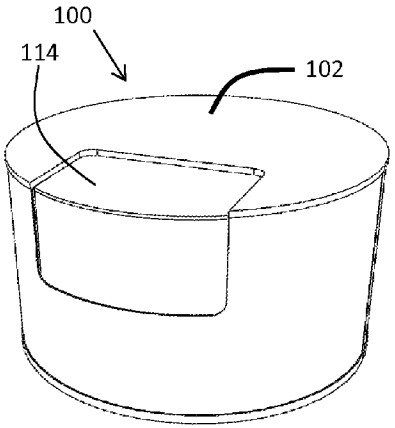
FIGS. 5*a*-5*f* show a series of perspective views of an automated centrifuge according to an embodiment of the invention, illustrating the door moving between a closed position and an open position.
Figure 5B:
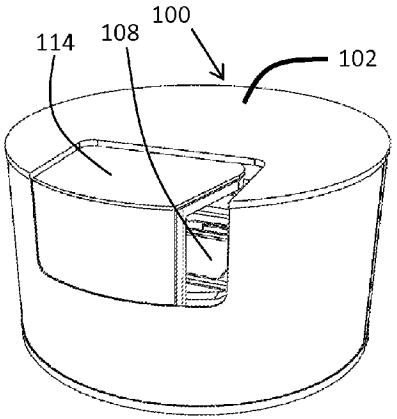
Figure 5C:
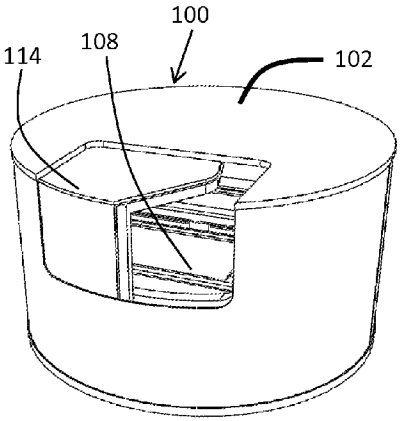
Figure 5D:
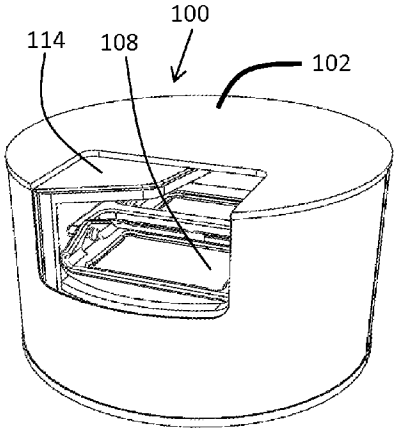
Figure 5E:
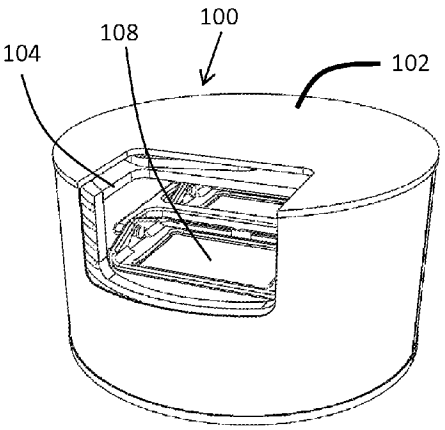
Figure 5F:
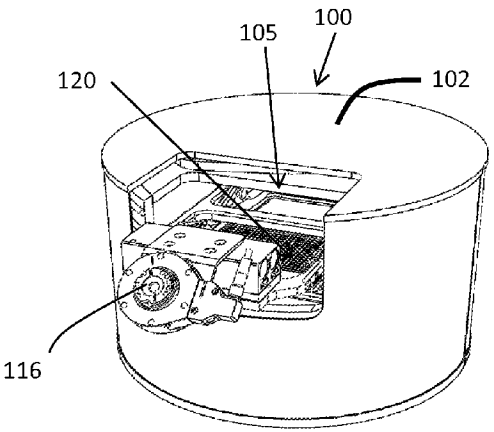

Turning to FIGS. 5*a*-5*f*, a series of views of automated centrifuge 100 is shown, illustrating door 114 moving from a fully closed position (FIG. 5*a*) to a fully open position (FIG. 5*f*). As can be seen in FIGS. 5*a*-5*f*, in one embodiment, door 114 can be configured such that it rotates around inner housing 104 to expose opening 105, while remaining within outer housing 102. As can be seen from FIGS. 5*b*-5*f*, as door 114 opens, opening 105 is exposed, and the internal mechanisms within automated centrifuge 100, for example, nest 108, can be accessed. As can be seen from the final view in FIG. 5*f*, once door 114 is in the open position, a robotic gripper 116 can access a microplate 120 positioned on nest 108 through opening 105.

It is understood that more than one door 114 can be used. For example, an inner and outer door could be used, an inner door 114 for inner housing 104 and an outer door 114 for outer housing 102. Both doors 114 can be configured to open and close as desired to expose/block opening 105 as discussed herein.

Figure 7:
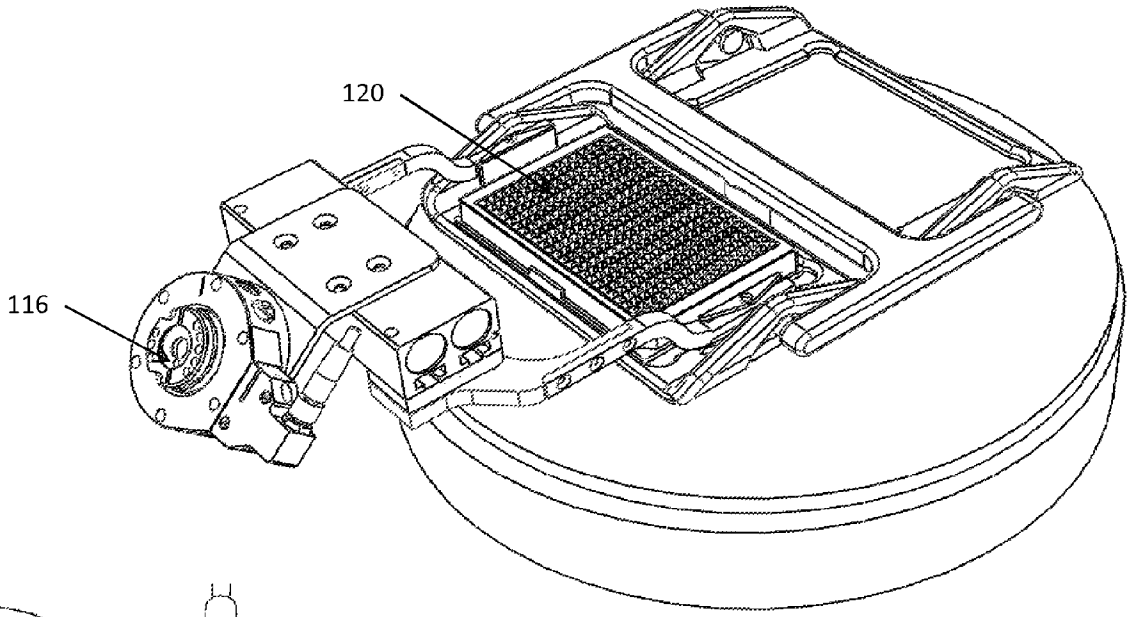
FIGS. 6 and 7 show perspective views of a robotic gripper used in connection with loading plates into an automated centrifuge according to an embodiment of the invention.
Figure 6:
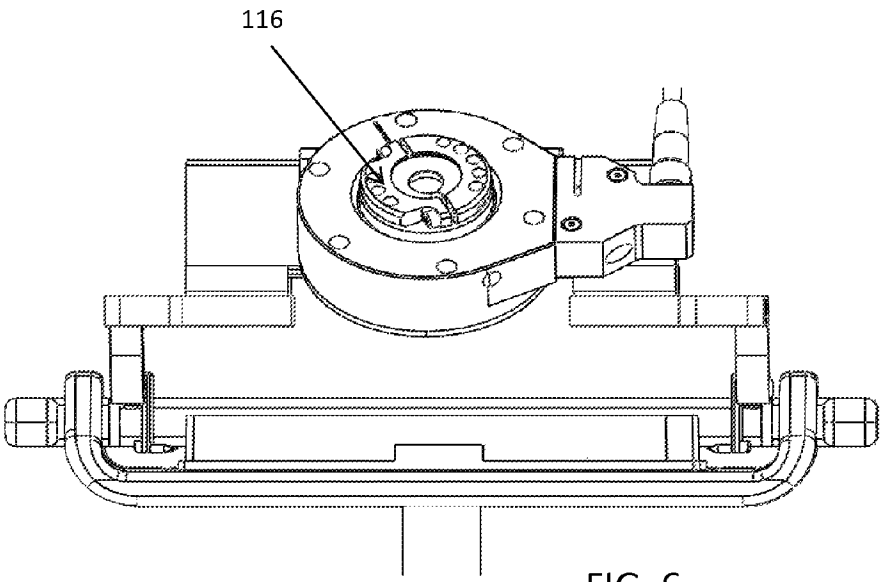

Turning to FIGS. 6 and 7, an example of a robotic gripper 116 used in connection with automated centrifuge 100 is shown. As shown in FIGS. 6 and 7, robotic gripper 116 can be configured to load labware (e.g., plates, tubes, racks of tubes, vials, racks of vials, or flasks). In the example shown in FIGS. 6 and 7, labware comprises plates 120, and robotic gripper 116 is configured to load plates 120 onto and off of a nest 108. Plates 120 can comprise any type of plates as known in the art used with centrifuges, for example, a microplate with a plurality of wells commonly used in the life sciences industry.

It is also noted that automated centrifuge 100 can include a mechanism for holding nest(s) 108 stationary to prevent swinging of nest(s) 108 while a plate 120 is being placed into a nest 108. In one example, a mechanism for holding nest(s) 108 stationary could comprise at least one retractable pin that could be actuated onto a top flat surface of nest 108, or at one or both of nest 108 pivot points.

Figure 8:
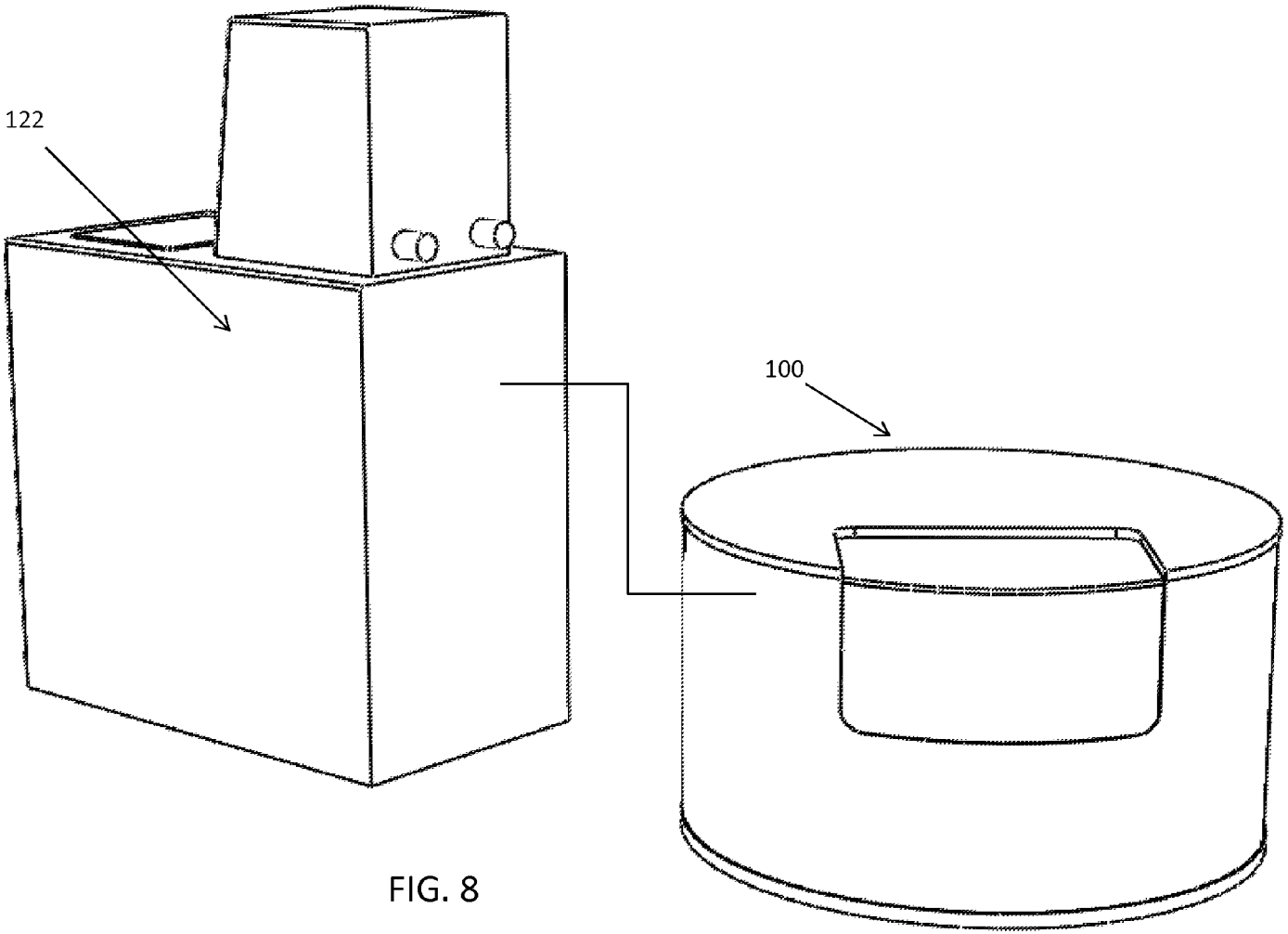
FIG. 8 shows a perspective view of an external chiller and automated centrifuge according to an embodiment of the invention.

Turning to FIG. 8, it is understood that an external chiller 122 can be used in connection with automated centrifuge 100 to provide cooling to the unit in order to control heat build-up during high-speed centrifugation. For example, external chiller 122 can provide coolant to coolant tubing 112. In another example, thermoelectric (e.g., Peltier) cooling could be utilized.

As door 114 and opening 105 are configured to allow simultaneous access to both a side and a top of automated centrifuge 100, it is understood that a robotic gripper 116 (either side-gripping or top-gripping) can be more easily configured to load and unload plates or other labware in and out of the centrifuge. This is in part because a robot can access centrifuge 100 horizontally through the side (i.e., front) opening (which is compatible with known side-gripping robotic systems) while centrifuge 100 is also accessible from, and viewable through, the top opening (which is compatible with known top-gripping robotic systems, and allows a robotic system to be more accurately calibrated and controlled). Accordingly, embodiments of the invention disclosed herein eliminate the need for a dedicated external robotic labware loader, as is required in some prior art systems. In addition, traditional robots in the industry typically include either side-gripping robots, or top-gripping robots. The embodiments discussed herein allow both types of robots to interface with the centrifuge door design of this invention.

The foregoing description of various aspects of the invention has been presented for the purpose of illustration and description. It is not intended to be exhaustive or to limit the invention to the precise form disclosed, and obviously, many modifications and variations are possible. Such variations and modifications that may be apparent to one skilled in the art are intended to be included within the scope of the present invention as defined by the accompanying claims.

What is claimed is:

1. A housing for an automated centrifuge, the housing comprising:

an inner housing for enclosing at least one labware nest of the automated centrifuge, the inner housing having a top and a substantially cylindrical body, wherein the inner housing includes an opening through both a portion of the top and a portion of the body;

a door configured to move between an open position in which the door exposes the opening and a closed position in which the door blocks the opening, wherein the door is configured to slide around an outer circumference of the inner housing; and a cylindrical outer housing enclosing the inner housing, wherein the cylindrical outer housing includes an outer opening substantially coinciding with the opening in the inner housing.

2. The housing of claim 1, further comprising coolant tubing wrapped around the cylindrical body of the inner housing.

3. The housing of claim 1, wherein the door has a first portion and a second portion, wherein the first portion is substantially perpendicular to the second portion.

4. The housing of claim 3, wherein the first portion of the door is pivotably attached to the top of the inner housing.

5. The housing of claim 3, wherein the second portion of the door is shaped to have a curvature substantially corresponding to a curvature of the cylindrical body of the inner housing.

6. The housing of claim 1, wherein in the open position, an interior of the inner housing is exposed such that a robotic gripper can access the at least one labware nest.

7. The housing of claim 1, wherein each at least one labware nest is configured to support a microplate, a tube, a rack of tubes, a vial, a rack of vials, or a flask.

8. The housing of claim 1, further comprising means for moving the door between the open and closed positions.

9. An automated centrifuge comprising:

at least one labware nest;

a rotor for rotating the at least one labware nest around a fixed axis;

an inner housing enclosing the at least one labware nest, the inner housing having a top and a substantially cylindrical body, wherein the inner housing includes an opening through both a portion of the top and a portion of the body;

a door configured to move between an open position in which the door exposes the opening and a closed position in which the door blocks the opening;

wherein the door is configured to slide around an outer circumference of the inner housing; and a cylindrical outer housing enclosing the inner housing, wherein the cylindrical outer housing includes an outer opening substantially coinciding with the opening in the inner housing.

10. The automated centrifuge of claim 9, wherein the door is configured to slide around an outer circumference of the inner housing.

11. The automated centrifuge of claim 9, further comprising coolant tubing wrapped around the cylindrical body of the inner housing.

12. The automated centrifuge of claim 9, wherein the door has a first portion and a second portion, wherein the first portion is substantially perpendicular to the second portion, and the first portion of the door is pivotably attached to the top of the inner housing.

13. The automated centrifuge of claim 12, wherein the second portion of the door is shaped to have a curvature substantially corresponding to a curvature of the cylindrical body of the inner housing.

14. The automated centrifuge of claim 9, wherein in the open position, an interior of the inner housing is exposed such that a robotic gripper can access the at least one labware nest.

15. The automated centrifuge of claim 9, further comprising a cylindrical outer housing enclosing the inner housing, wherein the cylindrical outer housing includes an outer opening substantially corresponding to the opening in the inner housing.

16. The automated centrifuge of claim 9, further comprising: means for moving the door between the open and closed positions.

17. The housing of claim 2, wherein the inner housing is radially inward of the cylindrical outer housing, wherein the coolant tubing is located radially between cylindrical body of the inner housing and the cylindrical outer housing.

18. The automated centrifuge of claim 11, wherein the inner housing is radially inward of the cylindrical outer housing, wherein the coolant tubing is located radially between cylindrical body of the inner housing and the cylindrical outer housing.

* * * * *